United States Patent [19]

Grzina

[11] Patent Number: 4,664,592

[45] Date of Patent: May 12, 1987

[54] CENTRIFUGAL PUMP IMPELLER CONFIGURED TO LIMIT FLUID RECIRCULATION

[75] Inventor: Anthony Grzina, Artarmon, Australia

[73] Assignee: Warman International Limited, Australia

[21] Appl. No.: 629,197

[22] Filed: Jul. 9, 1984

[30] Foreign Application Priority Data

Jul. 14, 1983 [AU] Australia ..... PG0282

[51] Int. Cl.[4] ..... F04D 29/08

[52] U.S. Cl. ..... 415/98; 415/170 A; 415/170 B; 416/186 R

[58] Field of Search ..... 415/98, 170 B, 113, 415/213 A, 97, 169 A, 86–87, 172 R, 170 A; 416/181, 179, 183–186, 199

[56] References Cited

U.S. PATENT DOCUMENTS

| | | | |
|---|---|---|---|
| 578,132 | 3/1897 | Attenhofer | 415/172 |
| 704,360 | 7/1902 | Neumann | 415/98 |
| 1,030,561 | 6/1912 | Blackmer et al. | 416/186 R |
| 1,383,354 | 7/1921 | Wareing | 416/183 |
| 1,645,498 | 10/1927 | Durdin | 416/186 R |
| 1,947,148 | 2/1934 | Andersen | 415/172 X |
| 2,207,317 | 7/1940 | Gear | 415/97 |
| 2,262,039 | 11/1941 | Pekor | 416/186 R |
| 3,246,605 | 4/1966 | Fisher | 415/98 |
| 3,384,026 | 5/1968 | Williamson, Jr. | 415/213 A |
| 3,535,051 | 10/1970 | Turner | 415/169 A |
| 3,918,829 | 11/1975 | Korzec | 415/213 A |
| 3,953,150 | 4/1976 | Onal | 416/184 |
| 4,129,402 | 12/1978 | Eberhardt | 415/172 R X |
| 4,253,798 | 3/1981 | Sugiura | 416/184 X |

FOREIGN PATENT DOCUMENTS

| | | | |
|---|---|---|---|
| 867933 | 3/1953 | Fed. Rep. of Germany | 415/172 A |
| 32406 | 3/1978 | Japan | 415/172 R |
| 62203 | 6/1978 | Japan | 415/170 B |
| 159785 | 3/1921 | United Kingdom | 415/172 |
| 751498 | 6/1956 | United Kingdom | 416/183 |
| 444898 | 12/1974 | U.S.S.R. | 415/172 R |
| 885615 | 11/1981 | U.S.S.R. | 415/170 B |
| 1038592 | 8/1983 | U.S.S.R. | 415/170 B |

*Primary Examiner*—Everette A. Powell, Jr.
*Attorney, Agent, or Firm*—Henry M. Bissell

[57] ABSTRACT

In a centrifugal pump, an enclosed-type impeller is provided with a plurality of auxiliary side vanes on either or both of the front and back faces of the impeller which project toward and conform with suitable running clearances to the walls of the casing adjacent the impeller. Annular members projecting axially from the sides of the impeller about the periphery thereof serve to limit circulation of working fluid into the spaces along the sides of the impeller. In one embodiment, the annular projection defines radially oriented passages or channels for transmitting fluid which is driven by the centrifugal action of the side vanes.

13 Claims, 5 Drawing Figures

FIG. 5
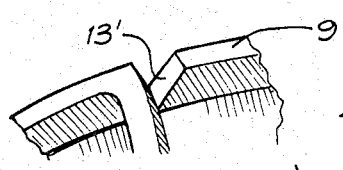
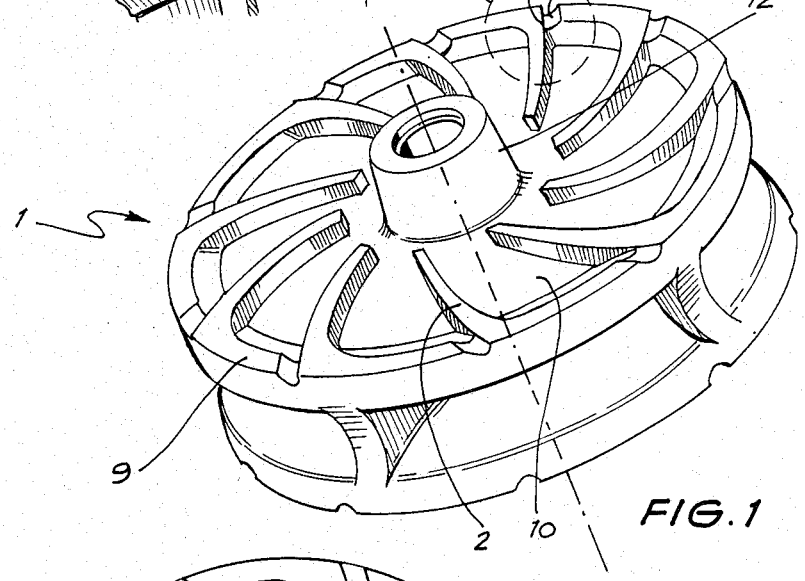
FIG. 1
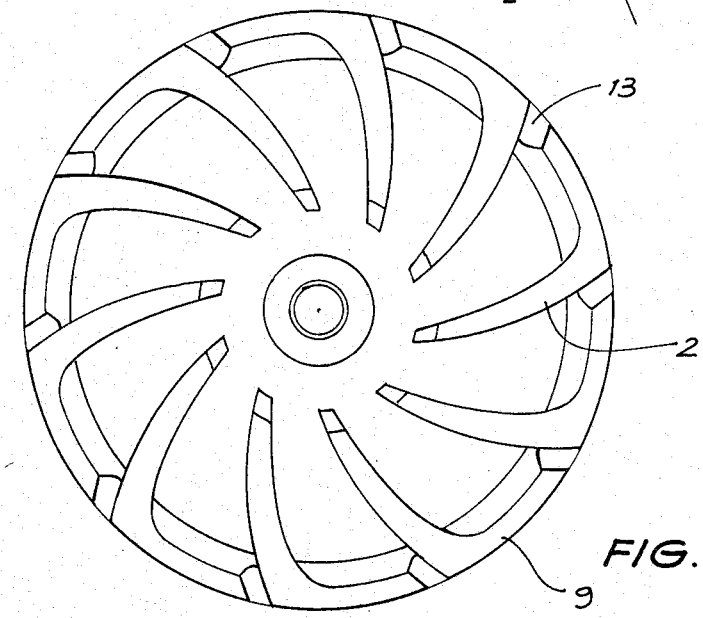
FIG. 2

CENTRIFUGAL PUMP IMPELLER CONFIGURED TO LIMIT FLUID RECIRCULATION

This invention relates to improvements in centrifugal pumps; more particularly to pumps used for pumping fluids with abrasive solids in suspension. A problem in pumping fluids of this nature is the abrasive action and wear on the components and resultant enlargement of clearances between the rotary and stationary members and consequent leakage and slippage of the fluid pumped, serious loss of head and efficiency and a reduction in serviceable life of the wearing parts, particularly the impeller and parts of the casing, or the casing liners, adjacent the sides of the impeller.

A means commonly employed to alleviate this problem is to provide the sides of the impeller with a plurality of vanes projecting towards, and conforming with suitable running clearance to the walls of the casing adjacent the impeller. These vanes can be of various designs such as straight radial, straight inclined to radial, curved or a combination of such shapes; their objective being to minimise, by their centrifugal action on the fluid in the side clearance spaces, leakage and ingress thereto of fluid with abrasive suspended particles discharged from the impeller. Such vanes as are in use and have been described for this purpose outwardly diverge so that at the circumference of the impeller the spacing between adjacent vanes is much greater—typically two or three times as great —as it is at the inner ends of the vanes. The consequence is a limited effectiveness of such vanes to minimise the inward rate of penetration by fluid discharged from the impeller and the associated ingress of abrasive particles into the side clearances between the impeller and casing.

It is the primary objective of this invention to provide improved impeller side vanes so designed as to virtually remove this limitation.

In one broad form the invention comprises a centrifugal pump comprising an impeller having vanes located on at least one side surface thereof and an annular projection running around the periphery of the impeller on the at least one surface of the impeller.

This annular projection could preferably extend all the way around the periphery of the impeller joining smoothly with the back vanes. The annular projection also could be broken between adjacent vanes by channels or passages.

The invention will now be described by way of example with reference to the accompanying drawings in which:

FIG. 1 illustrates a perspective view of the impeller of one embodiment of the present invention showing the position of the back vanes;

FIG. 2 illustrates a plan view of the impeller illustrated in FIG. 1;

FIG. 5 illustrates an alternative construction of the annular projection at the detail A in FIG. 1.

Figure 3:
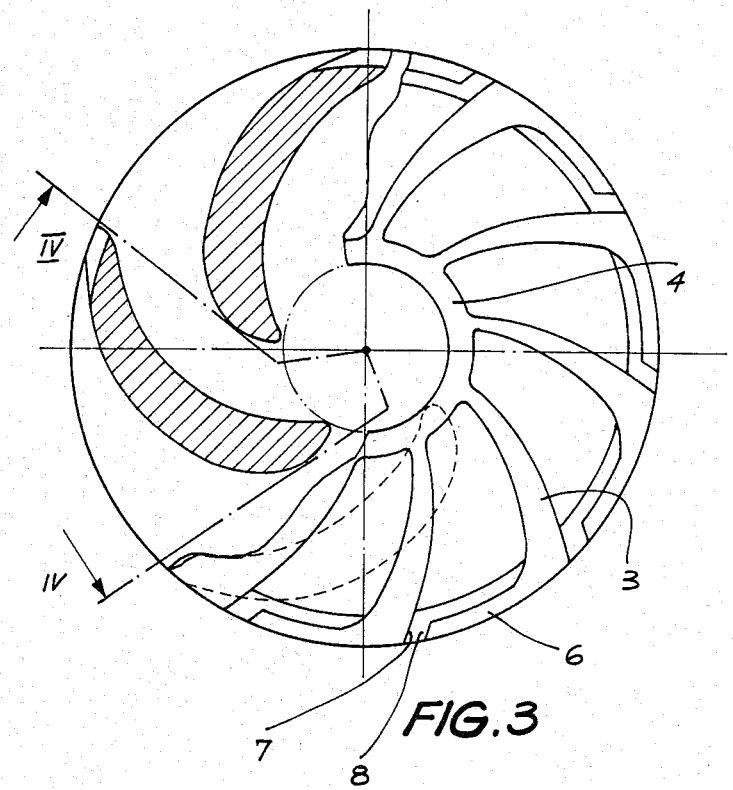
FIG. 3 illustrates a cut away plan view of the impeller illustrated in FIG. 1 showing the positions of the front vanes.
Figure 4:
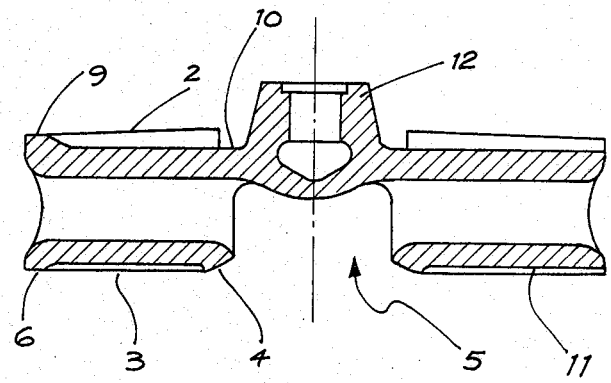
FIG. 4 is a part sectional view taken in the direction of the arrows IV in FIG. 3.

The embodiment of the invention as shown in the beforementioned drawings comprises an impeller having a plurality of identical vanes 2 and 3, equally spaced and axi-symmetric with the impeller 1, outwardly projecting from the sides thereof and conforming with suitable running clearances to the walls of the casing within which the impeller rotates. As shown in FIGS. 3 and 4 there is located on the front face 11 an annular projection 4 adjacent the intake opening 5, with the vanes 3 extending therefrom in a curved and backwardly sloping (with respect to the direction of rotation of the impeller) form to the periphery of the impeller where it mates and blends in with an annular projection 6 co-incident at its outer surface with the periphery of the impeller.

This annular projection 6 can completely extend around the periphery of the impeller or can be broken by channels or ports at suitable positions between the vanes. However, in the embodiment illustrated the annular projection 6 is interrupted between each pair of adjacent vanes 3 at a short distance from the leading face 7 of the next vane to form a channel 8 between vanes which is of substantially less width than the outer circumferential spacing of the vanes.

As shown in FIGS. 1 and 2, the back vanes 2 are formed as projections from the back face 10 of the impeller which commence adjacent the central boss 12 and extend in a curved and backwardly sloping (with respect to the direction of rotation of the impeller) form to the periphery of the impeller where they mate with an annular projection 9 which can extend completely around the periphery of the impeller. However, this annular projection can be broken or interrupted between adjacent vanes to form a plurality of passages or ports 13. As shown in FIG. 1, the annular projection is broken to form a passage 13 adjacent the leading face 14 of the next vane, which passage 13 is of substantially less width than the outer circumferential spacing of the vanes, and which passage is of a depth, i.e., axial dimension, which is less than the height (axial dimension) of the annular projection 9.

An alternative construction of this passage shown in FIG. 5 wherein the passage 13' extends in depth through the annular projection 9 down to the back face 10 so that the axial dimensions of the passage and of the annular projection are equal.

Typically both the front and back vanes, according to embodiments of the present invention, would project axially from the front and back surfaces of the impeller from 5 to 10% of the outer circumferential spacing of the vanes, the width or circumferential thickness, of the vanes would approximate 20 to 25% of the circumferential spacing of the vanes at any given radial distance from the axis and the width, or circumferential dimension, of the peripheral passage or port between the vanes would be approximately 10% of the outer circumferential spacing of the vanes. It is preferred that the minimum dimensions of the port of passage is such to ensure the outward discharge from between the vanes of large particles that might otherwise accumulate and cause wear or jamming between the impeller and the casing.

It should be obvious to people skilled in the art that modifications can be made to the invention as described above without departing from the spirit or the scope of the invention.

I claim:

1. An impeller for a centrifugal pump comprising:

a planar rotatable member having an axis of rotation;

a plurality of substantially radially extending primary vanes located on one face of said rotatable member and forming a central intake opening aligned along the axis of rotation, said primary vanes being adapted to pump liquid through the pump when said impeller is positioned in a pump casing;

a plurality of generally radially directed auxiliary vanes located on the other face of said rotatable member and extending from near a central portion of said other face to adjacent the periphery of the rotatable member, said auxiliary vanes projecting axially from said other face;

an annular projection running about the periphery of the outer ends of said auxiliary vanes to limit recirculation of the working fluid of the pump along said other face; and channels located in said annular projection between adjacent auxiliary vanes.

2. An impeller for a centrifugal pump comprising:

two substantially parallel rotatable members aligned to rotate about a common axis of rotation and defining a central intake opening in one of the rotatable members aligned along the axis of rotation;

a plurality of substantially radially extending primary vanes extending between the rotatable members, and extending generally radially from the axis of rotation, so as to, when said impeller is installed in a pump casing, pump liquid through the pump;

a plurality of generally radially directed auxiliary vanes located on an outer face of at least one of the rotatable members from near a central portion of said outer face to adjacent the periphery of the rotatable member, said vanes projecting axially from said outer face;

an annular projection running about the periphery of the rotatable member along said outer face and connecting with the outer ends of said auxiliary vanes to limit recirculation of the working fluid of the pump along said outer face; and channels located in said annular projecting between adjacent auxiliary vanes.

3. The impeller of claim 2 wherein the impeller has a pair of opposite side faces, including said at least one side face and a second side face, extending generally radially from the hub and the intake opening, respectively, and further including a second plurality of vanes projecting axially from the second side face and extending generally radially from a position near a central portion of said second side face to adjacent the periphery of the rotatable member, and a second annular projection running about the periphery of the rotatable member and connecting with the outer ends of the vanes on the second side face to limit recirculation of the working fluid of the pump along the second side face.

4. The impeller of claim 1 wherein the channels are located adjacent the leading faces of respective auxiliary vanes.

5. The impeller of claim 4 wherein the axial dimension of the channels is less than the axial dimension of the annular projections.

6. The impeller of claim 4 wherein the axial dimension of the channels equals the axial dimension of the annular projections.

7. The impeller of claim 4 wherein the circumferential dimension of the channel is substantially less than the spacing between the auxiliary vanes at the periphery of the impeller but is sufficient to insure the passage therethrough of particles encountered in the working fluid of the pump.

8. The impeller of claim 7 wherein the transverse dimension of each channel is equal to approximately one-tenth the circumferential spacing between the auxiliary vanes.

9. The impeller of claim 3 or claim 2 wherein the channels are located adjacent the leading faces of respective auxiliary vanes.

10. The impeller of claim 9 wherein the axial dimension of the channels is less than the axial dimension of the annular projections.

11. The impeller of claim 9 wherein the axial dimension of the channels equals the axial dimension of the annular projections.

12. The impeller of claim 9 wherein the circumferential dimension of the channel is substantially less than the spacing between the auxiliary vanes at the periphery of the impeller but is sufficient to insure the passage therethrough the particles encountered in the working fluid of the pump.

13. The impeller of claim 12 wherein the transverse dimension of each channel is equal to approximately one-tenth the circumferential spacing between the auxiliary vanes.

* * * * *

UNITED STATES PATENT AND TRADEMARK OFFICE

CERTIFICATE OF CORRECTION

PATENT NO. : 4,664,592

DATED : May 12, 1987

INVENTOR(S) : Anthony Grzina

It is certified that error appears in the above—identified patent and that said Letters Patent is hereby corrected as shown below:

Column 3, line 36 "projecting" should be --projection--;

Column 3, line 42, after "plurality of" insert --auxiliary--;

Column 4, line 4, before "vanes" insert --auxiliary--;

Column 4, lines 10, 13 and 16, for the claim reference numeral "4", each occurrence, substitute --9--;

Column 4, lines 29, 32 and 35, for the claim reference numeral "9", each occurrence, substitute --4--;

Column 4, line 39, after "therethrough" delete "the" and substitute --of--.

Signed and Sealed this

Ninth Day of February, 1993

*Attest:*

STEPHEN G. KUNIN

*Attesting Officer*

*Acting Commissioner of Patents and Trademarks*